United States Patent [19]

Morrow

[11] Patent Number: 4,502,170

[45] Date of Patent: Mar. 5, 1985

[54] PHYSIOLOGIC SUPPORT SYSTEM AND METHOD

[75] Inventor: Winston G. Morrow, Portland, Oreg.

[73] Assignee: Spinal Dynamics, Inc., Portland, Oreg.

[21] Appl. No.: 384,107

[22] Filed: Jun. 1, 1982

Related U.S. Application Data

[63] Continuation-in-part of Ser. No. 210,212, Nov. 25, 1980, abandoned, and a continuation-in-part of Ser. No. 218,719, Dec. 22, 1980.

[51] Int. Cl.[3] ..... A47G 9/00

[52] U.S. Cl. ..... 5/431; 5/443; 128/80 R

[58] Field of Search ..... 5/443, 444, 431, 432, 5/433, 434, 436, 437; 128/135, 80 R

[56] References Cited

U.S. PATENT DOCUMENTS

| | | | |
|---|---|---|---|
| 885,243 | 4/1908 | Haas | 5/431 |
| 1,045,228 | 11/1912 | Wrltmer | 5/436 |
| 2,139,028 | 12/1938 | Mensendicck . | |
| 2,896,227 | 7/1959 | Reed | 5/436 |
| 3,333,286 | 8/1967 | Blolik | 5/431 |
| 3,359,577 | 12/1967 | Rogers | 5/431 |
| 4,275,714 | 6/1981 | Lewis | 5/436 |
| 4,424,599 | 1/1984 | Mannoucme | 5/436 |

FOREIGN PATENT DOCUMENTS

| | | | |
|---|---|---|---|
| 1273761 | 7/1968 | Fed. Rep. of Germany . | |
| 2418125 | 10/1975 | Fed. Rep. of Germany . | |
| 1241643 | 8/1960 | France | 5/436 |
| 2263740 | 10/1975 | France | 5/436 |
| 140046 | 8/1930 | Switzerland . | |
| 565533 | 8/1975 | Switzerland | 5/436 |

*Primary Examiner*—Alexander Grosz
*Attorney, Agent, or Firm*—Klarquist, Sparkman, Campbell, Leigh & Whinston

[57] ABSTRACT

A method is provided for improving posture and relieving back pain of a person in a supine position. The invention includes the steps of pressing a convex pillow against the region of the ilia, sacrum, and fifth lumbar vertebra to produce a substantial sacral base angle and to fully oppose any moment tending to cause rotational shifting of the pelvis, and supporting the thighs and calves in an elevated position such that the thighs extend upwardly at an angle of from about 53° to 63° from horizontal, and the calves extend at an angle of from about 0° to 20° downwardly from horizontal. The method normally also includes simultaneously resiliently supporting the back of the neck in an elevated position while permitting the cervical vertebrae to maintain their normal, physiologic curvature, in supporting the head of the person in an elevated position while maintaining the cervical vertebrae and the occiput in an unflexed, physiologic position.

1 Claim, 4 Drawing Figures

FIG.1
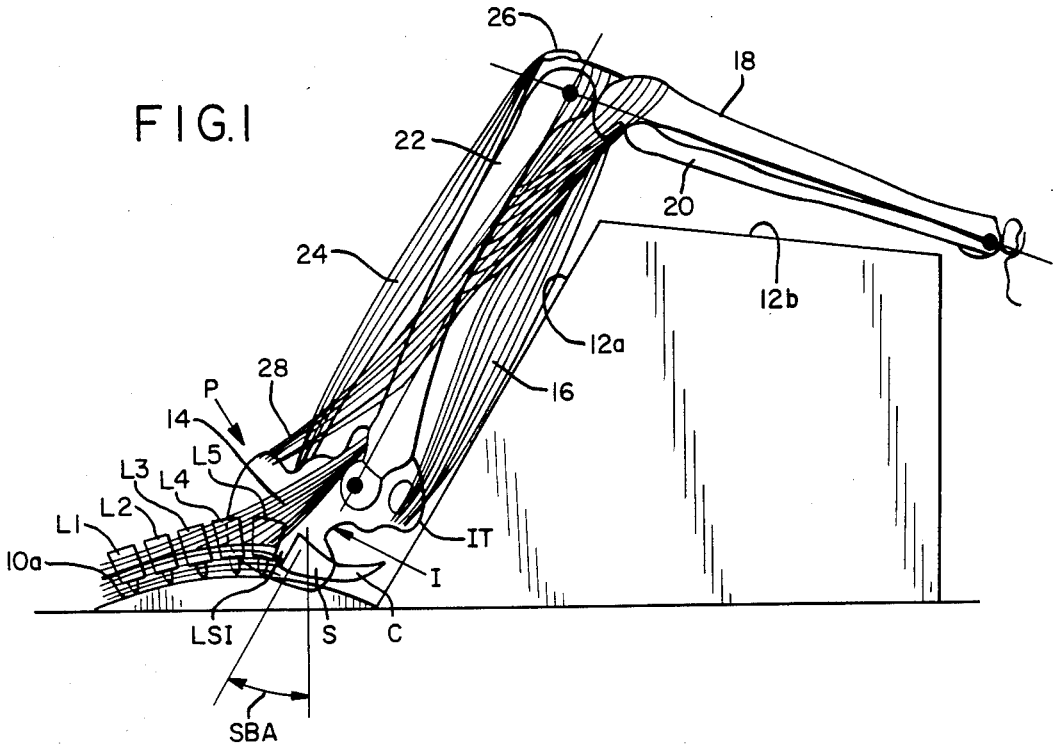
FIG. 2
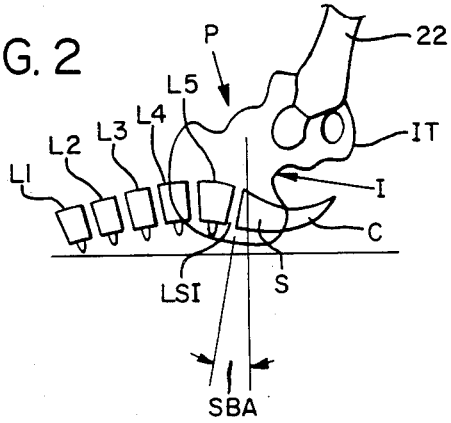
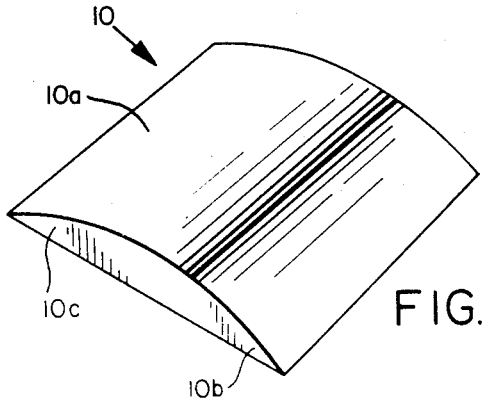
FIG.3
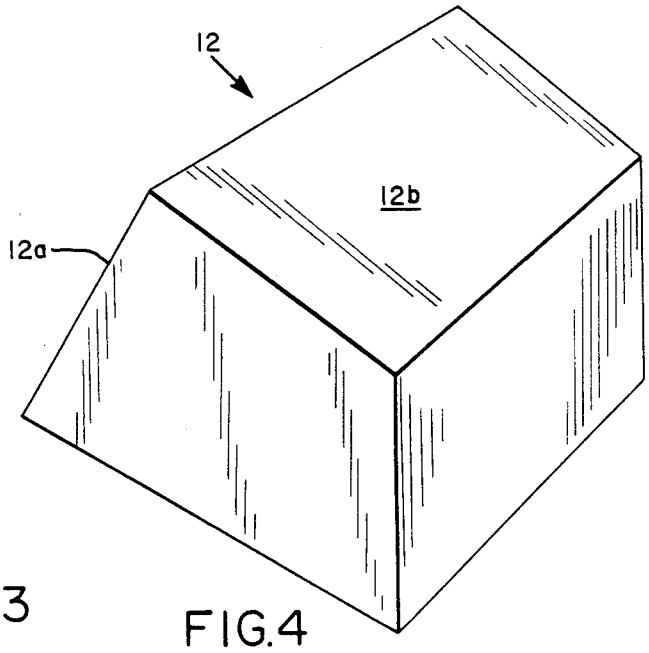
FIG.4

PHYSIOLOGIC SUPPORT SYSTEM AND METHOD

BACKGROUND OF THE INVENTION

This application is a continuation-in-part of my prior applications filed on Nov. 25, 1980, and Dec. 22, 1980, Ser. Nos. 210,212 now abandoned, and 218,719, entitled PELVIC SUPPORT METHOD AND MEANS and HEAD AND NECK CUSHION, respectively. The specifications and drawings of these prior applications are incorporated herein by reference.

BACKGROUND OF THE INVENTION

This invention relates to a system and method for relieving spinal stress and for improving posture.

Viewed from the side, the human spine includes four basic regions, each of which has its own curvature. The uppermost or cervical portion is made up of the cervical vertebrae and is concave posteriorly. The thoracic portion immediately below the cervical portion is made up of the thoracic vertebrae and is convex posteriorly. The lumbar portion is concave posteriorly and is made up of the lumbar vertebrae. The lowermost or sacral portion is fixed in position as a result of total fusion of the sacral vertebrae and is convex posteriorly.

The degree and configuration of the curvature of any of these portions of the spine is interrelated with the curvature of the other portions, all of which are directly affected by pelvic position. The sum of these curves is, in essence, posture. Inheritance, disease, and habit are the three major factors influencing posture. Of these factors, habit is the most common problem and is often the most debilitative due to the adverse effects of gravity on the spinal column and on the other improperly positioned and inadequately supported parts of the body.

Habitual or prolonged unnatural body position can cause fatigue and strain upon ligaments, and increased muscular demand can cause pain and compensatory postural tension. Moreover, prolonged poor body posture can increase or decrease the range of motion of the vertebrae by stretching or tightening ligaments, thereby effecting muscle activity by accommodation or compensation.

Erect physiologic posture, i.e., ligamentous posture, is a well-known mechanism for energy conservation where the ligaments offer maximum support with small, intermittent muscular contractions. In a balanced, erect human frame, the musculature is electromyographically silent except for the gastrocnemius and soleus group.

In a sitting posture, this mechanism appears to function if proper pelvic position is maintained. In a supine position, however, there is no balancing of the ligamentous joints; there is only stress applied. Thus, lying down produces the most constant postural stress, because it is in this posture that the neuro-musculo-skeletal system must rely most on the integrity of the spinal components for physiologic function. It is therefore the supine position which offers the greatest corrective potential to a loss of neuro-musculo-skeletal integrity.

By supporting the human frame in a posture that is physiologically neutral, a position of physiological rest can be obtained. The term "physiologic" as used herein is intended to define that postural position wherein the parts of the body, particularly the vertebrae of the spine, are in their normal, comfortable, unstressed position, a position which approximates that of an erect, standing individual. Prior art efforts at achieving physiologic posture typically either result in a flattening of the spinal column or in exaggerating the curvature, thereby resulting in flexion or extension of the vertebrae, respectively.

Thus, the present invention has as its objects any one or more of the following, taken individually or in combination with one another:

(1) To provide a system for supporting the entire body in a physiologic condition when the person is in a supine position, thereby reducing the amount of muscular and neurological exertion necessary, thus providing greater muscular control, tone, and strength of the body;

(2) To improve posture by remodeling spinal curvature utilizing supports which maintain the vertebrae in a position approximately that of an erect, physiologic, standing posture;

(3) To develop a method for relieving stress or fatigue and resulting discomfort of the vertebrae and associated ligaments, tendons, and muscles;

(4) The provision of a system for reducing pain during vertebral diagnostic testing;

(5) To encourage ligamentous spinal curvature without resulting in flexion or exaggerated extension of the vertebrae; and (6) To provide a method for performing back exercises which eliminates the adverse effects of gravity and habit.

SUMMARY OF THE INVENTION

This invention provides a method for improving posture and relieving lower back pain including the steps of pressing a convex pillow against the region of the ilia, sacrum, and fifth lumbar vertebra to produce a substantial sacral base angle and fully oppose any moment tending to cause rotational shifting of the pelvis, and supporting the thighs and calves in an elevated position such that the thighs extend upwardly at an angle of from about 53° to 63° from horizontal, and the calves extend at an angle of from about 0° to 20° downwardly from horizontal. The term "substantial sacral base angle" is intended to define an angle which is greater than the range of approximately 0° to 10° likely to be present without the pillow of this invention. The legs are normally supported in this position by a second pillow, having a thigh-supporting portion to support the thighs and calves in the desired position.

The method normally also involves simultaneously supporting the back of the neck in an elevated position while permitting the cervical vertebrae to maintain their normal, physiological curvature, and supporting the head of the person in an elevated position while maintaining the cervical vertebrae and the occiput in an unflexed, physiologic position. The desired position of the cervical vertebrae may be alternatively defined as being positioned such that the vertebral plane lines thereof converge posteriorly in a symmetrical pattern without occipital pressure.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic side elevation view of the hip-femur complex of a person practicing one embodiment of the present invention;

FIG. 2 is a schematic side elevation view of the lumbar vertebrae of a person lying supine without any pelvic support;

FIG. 3 is a perspective view of a pillow used to support the lumbo-sacral pelvic area when practicing the method depicted in FIG. 1; and FIG. 4 is a perspective view of a pillow used to support the thighs and calves of the person when practicing the method depicted in FIG. 1.

DETAILED DESCRIPTION OF THE PREFERRED EMBODIMENT

My head and neck cushion, which is designed to reduce stress in the cervical region of the spine, is described in detail in my prior application Ser. No. 218,719. The spine is a continuous column having different regions which are intimately tied to one another so that any stress to or treatment of one region necessarily has an effect elsewhere on the spinal column. Therefore, to correct problems relating to the cervical vertebrae it is highly desirable that the other regions of the spine be treated simultaneously. With this in mind, the present application discloses a system and method for supporting the lumbar region of the spine as well as the hip-femur complex.

The Pertinent Anatomy

FIG. 1 depicts the lumbar region and the hip-femur complex being supported by a pelvic support pillow 10 and a thigh-calf support pillow 12. In FIG. 1, the lumbar vertebrae are designated L-1 through L-5, which is a common designation for these spinal components. As mentioned above, these vertebrae, along with the ligaments and tendons which hold them in place, define an posterior curve (or a downward curve in FIG. 1). The sacrum S in combination with the coccyx C define a posteriorly or downwardly convex curve immediately inferior of the lumbar curve (or to the right in FIG. 1). The sacrum S is centrally mounted to the ilia I by ligaments (not shown) which provide a limited amount of movement therebetween. The so-called lumbosacral interspace (identified with the letters LSI) comprises a gap between the sacrum S and L-5. The relative movement between the sacrum S and L-5 at the lumbosacral interspace LSI is critical since the lumbosacral interspace LSI normally accounts for an estimated 75 percent of all lumbar flexion. Thus, with no support being provided at the lumbosacral interspace the greatest kinetic strain potential exists here.

The ilia I are sometimes referred to as the pelvic bone, although the term "pelvis" as used herein (designated with the letter P) is intended to define the region encompassing the ilia I and the sacrum S. The two laterally spaced, inferiorly extending (rightwardly extending in FIG. 1) points at the bottom of the ilia I are termed the ischial tuberosities, and are designated with the letters IT.

In defining the position of the sacrum S as well as the other elements of the pelvis P, the term "sacral base angle" has been and will be utilized herein. This angle is defined between a line drawn across the superior base of the sacrum S and the vertical as depicted in FIG. 1 and is identified with the letters SBA.

FIG. 2 depicts the position of the pertinent skeletal components of a person lying in a supine position on a flat horizontal surface without any pelvic support. It can be seen that the sacral base angle SBA is quite small, approximately 10°. This spastic flattening of the the lumbar curve brings about alteration of the thoracic and cervical curves which further stresses the spinal musculature, causing more fatigue and more spasms. It also results in unlocking of the ligamentous joints of the spine and pelvis, thus causing stress to the pelvic muscles which the person may utilize in an attempt to keep the pelvis in the proper position. This protracted muscular stress results in discomfort and strain due to fatigue. Additionally, irritation can arise from prolonged muscle spasm, and in the presence of disc degeneration among those persons with back problems, the spasm can constitute significant compressive force which might result in aberrant neuronal, vascular and lymphatic alteration.

Various means have been attempted in the past to maintain proper curvature of the spine when the person is in a supine position. However, these efforts concentrate on providing support to the upper lumbar vertebrae, i.e., L-1 through L-4. Thus, such designs provide little, if any, support to the ilia I or the sacrum S and are incapable of producing a substantial sacral base angle or to fully oppose moments tending to cause rotational shifting of the pelvis.

Pelvic Support Pillow

Reference to FIGS. 1, 3, and 4 show that the present invention overcomes these problems by providing a pelvic support pillow 10 which includes a substantially convex surface 10*a*. The term "convex" as used herein is intended to define any outwardly curved surface, which need not be symmetrical. Pillow 10 is preferably made of resilient material, with the portion 10*b* at the lower or right hand end in FIGS. 1 and 3, i.e., that portion under the sacrum S being of somewhat greater density than the rest of the pillow 10*c*. In any event, the density depends upon the amount of weight, that is the size of person, intended to be supported.

With pelvic support pillow 10 in place below the pelvis P of the person, it can be seen that the apex of convex surface 10*a* contacts the ilia I, the sacrum S, and normally vertebrae L-5 through L-1. The word "contacts" as used herein, of course, merely means that pelvic support pillow 10 touches the skin and fleshy portions of the body immediately behind the ilia I, sacrum S, and the pertinent vertebrae.

With the sacrum S being supported by pelvic support pillow 10, a substantial sacral base angle SBA, normally of between 25° and 45°, is effected. This approximates the sacral base angle SBA when an average person is in an erect, physiologic, standing position. In the depicted embodiment, the sacral base angle SBA equals 27°, which is in the normal range of ligamentous posture. The term "ligamentous" as it relates to posture is used herein to mean that physiologic posture which permits the joints of the body to rely upon their surrounding ligaments for their support, requiring only intermittent, minor muscular contractions triggered by the reflexes of the joints and ligaments; that is, substantial, continuous muscular effort is not required when ligamentous posture has been achieved.

With the pelvis P supported in the depicted physiologic position, the lumbosacral interspace LSI is firmly held in position, thereby limiting the amount of movement between the sacrum S and L-5. This is an important feature of the invention because, as mentioned above, the lumbosacral interspace LSI accounts for as much as 75 percent of all lumbar flexion. In this physiologic position the spine is also physiologic, erect, and static, requiring minimum muscular effort on the part of the person using pelvic support pillow 10. This low degree of muscular effort is made possible because physiologic, erect balance is essentially a ligamentous function. Such ligamentous posture is, as mentioned above, effortless and therefore nonfatiguing.

Thigh-Calf Support

Thigh-calf support 12 is also included in this preferred embodiment of the present invention. Support 12 is generally trapezoidal in linear cross section and includes a thigh-supporting surface 12*a* and a calf-supporting surface 12*b*. The angulation of these two surfaces is such that the muscles of the leg, particularly the upper thigh, exert forces on the pelvis P which are consistent with and supportive of the forces which are being exerted by pelvic support pillow 10.

Like pelvic support pillow 10, thigh-calf support 12 is typically formed of resilient material. Preferably calf-supporting surface 12*b* is somewhat more resilient than the rest of the support 12, but this is not a critical feature.

Only a few of the most important muscles have been depicted in FIG. 1 for the sake of simplicity. These are the psoas group 14 which extends from the anterior side of the pelvis to the lumbar vertebrae L-1 through L-5, the hamstrings 16 which extend from the superior ends of the tibia 18 and the fibula 20 to the femur 22 and the pelvis P at a point adjacent the ischial tuberosities IT. Also depicted are the quadriceps 24 which extend from the patella 26 to the pelvis P. The tensor fascia lata 28 are also depicted extending from the juncture of the superior end of tibia 18 and the inferior end of femur 22 to the superior region of femur 22 and to the superior portions of the ilia I.

It is most desirable that thigh-supporting surface 12*a* extend at an angle of from 53° to 63° with respect to horizontal and that calf-supporting surface 12*b* extend at an angle of 0° to 20° with respect to horizontal. Described another way, the angulation of surface 12*a* is 117° to 127° with respect to the substantially flat surface upon which pelvic support pillow 10 and the remainder of the person's back rests. The relative angulation of surface 12*b* would remain the same; i.e., 0° to 20° with respect to that flat surface. This alternative definition recognizes that the entire body may be rotationally shifted as much as 45° in a clockwise direction from the position depicted, with pelvis P being the axis of rotation.

In the depicted, preferred embodiment, thigh-supporting 12*a* extends at an angle of 58° with respect to horizontal, and calf-supporting surface extends at an angle of 5°. This appears to be a neutral position for the hamstrings 16, quadriceps 24, the psoas group 14, and the tensor fascia lata muscles, as well as the other major muscles of the hip and thigh, which for the purposes of simplification have not been depicted in FIG. 1. Also, the femurs 22 are effectively suspended with minimal traction to their insertion at the pelvis P. This position is also highly desirable to reduce otherwise required muscular effort.

The combination of pelvic support pillow 10 and thigh-calf support 12 permits a ligamentous, physiologic position to be maintained. This results in many dramatic advantages over support systems which require muscular effort. For example, use of pillow 10 and support 12 results in a marked reduction of pain for discogenic disorders, i.e., those caused by derangement of intervertebral discs, because prolonged muscle spasms in the presence of disc degeneration can constitute a significant oppressive force with resulting pain, and further reflect spasms. It is noteworthy that the abdominal musculature, including the internal and external oblique muscles, relax dramatically when pelvic support pillow 10 and thigh-calf support 12 are employed, thus suggesting an application to post-abdominal surgery, as well as to situations where traction is called for. When pillow 10 and support 12 are used together, a marked increase in the strength of the body is observable using standard muscle tests. It is also noticeable when pillow 10 and support 12 are utilized that blood pressure drops. This is not surprising in view of the physiologic changes which occur during relaxation and stress reduction. Moreover, use of the described system permits relaxation of the neuromuscular circuitry, which is not possible with positions which require muscular effort. In fact, it has been found that the present invention virtually eliminates even the intermittent, minor muscular contractions normally required when the body is subjected to the forces of gravity.

Finally, use of pillow 10 and support 12 permits various back and pelvis exercises in which the adverse effects of gravity and habit can be eliminated while such exercises are being performed. This last advantage is important because it permits the bilateral musculature, i.e., the muscles on each side of the body to be evenly exercised in an environment which reduces distortional effects resulting from preexisting neurological and/or muscular problems. If these distortional effects are not eliminated, exercise may even accentuate the problems.

Head and Neck Cushion

As mentioned above, because the spine acts as a unit and proper treatment of any single part desirably includes treatment of the entire spine, it is highly desirable that the head and neck cushion disclosed in my patent application Ser. No. 218,719 be utilized simultaneously with pelvic support pillow 10 and thigh-calf support 12. When so used, the advantages discussed above with respect to pillow 10 and support 12 are evident to an even greater extent. It is also noticeable during testing of shoulder disorders that pain which is normal in testing without the three described supports, utilization of the supports results in a dramatic reduction or even an elimination of pain. It is likely that this pheonomenon would occur with testing of other disorders as well.

Of course, it should be understood that various changes and modifications of the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. A system for improving the posture and relieving lower back pain of a person in a supine position comprising:

a substantially convex back pillow including means for supporting the ilia, sacrum, and fifth lumbar vertebra to produce a substantial sacral base angle and to fully oppose any moment to cause rotational shifting of the pelvis, said back pillow being a crescent-shaped, resilient member comprising an upper portion and a lower portion, the lower portion being formed of a resilient material having a greater density than the material forming the upper portion so that, when the pillow is positioned behind the user's back with the lower portion aligned with the user's sacrum, said pillow preferentially supports the pelvis below the lumbar region to oppose said moment causing rotational shifting of the pelvis; and a pillow having a first, thigh-supporting surface extending upwardly at an angle of from about 53° to 63° from horizontal and a calf-supporting surface extending at an angle of from about 0° to 20° downwardly from horizontal.

* * * * *

UNITED STATES PATENT AND TRADEMARK OFFICE

CERTIFICATE OF CORRECTION

PATENT NO. : 4,502,170

DATED : March 5, 1985

INVENTOR(S) : Winston G. Morrow

It is certified that error appears in the above-identified patent and that said Letters Patent is hereby corrected as shown below:

"References Cited", "Wrltmer" should be --Weltmer--;

"Mannoucme" should be --Hannouche--;

Column 1, line 5, delete "BACKGROUND OF THE INVENTION"; and

Column 1, line 8, "210,212" should read -- 537,822, now Patent No. 4,489,982, which is a continuation-in-part of of Ser. No. 210,212, now abandoned --.

Signed and Sealed this

*Twelfth* Day of *November 1985*

[SEAL]

*Attest:*

*Attesting Officer*

DONALD J. QUIGG

*Commissioner of Patents and Trademarks*